US012410983B2

(12) United States Patent
Graham, II et al.

(10) Patent No.: US 12,410,983 B2
(45) Date of Patent: Sep. 9, 2025

(54) FIREARM SUPPRESSOR WITH COMPONENTS OF TWO OR MORE MATERIALS

(71) Applicant: Rugged Design, Inc., Travelers Rest, NC (US)

(72) Inventors: Henry L. Graham, II, Landrum, SC (US); George Michael Derdziak, Greenville, SC (US)

(73) Assignee: Rugged Design, Inc., Travelers Rest, SC (US)

( * ) Notice: Subject to any disclaimer, the term of this patent is extended or adjusted under 35 U.S.C. 154(b) by 912 days.

(21) Appl. No.: 16/988,018

(22) Filed: Aug. 7, 2020

(65) Prior Publication Data

US 2021/0116200 A1 Apr. 22, 2021

Related U.S. Application Data

(60) Provisional application No. 62/884,920, filed on Aug. 9, 2019.

(51) Int. Cl.
*F41A 21/30* (2006.01)

(52) U.S. Cl.
CPC ..... *F41A 21/30* (2013.01)

(58) Field of Classification Search
CPC ..... F41A 21/30
USPC ..... 181/223; 89/14.4
See application file for complete search history.

(56) References Cited

U.S. PATENT DOCUMENTS

| | | | | |
|---|---|---|---|---|
| 5,164,535 | A * | 11/1992 | Leasure | F41A 21/30 89/14.4 |
| 6,374,718 | B1 * | 4/2002 | Rescigno | F41A 21/30 89/14.4 |
| 7,661,349 | B1 | 2/2010 | Brittingham | |
| 9,366,495 | B1 * | 6/2016 | Coppinger | F41A 21/30 |
| 9,921,021 | B1 | 3/2018 | Graham, II | |
| 10,054,384 | B1 | 8/2018 | Marfione | |
| 10,088,259 | B2 | 10/2018 | Dueck et al. | |
| 10,119,779 | B1 * | 11/2018 | Miele | F41A 21/30 |
| 10,126,083 | B2 | 11/2018 | Groves | |
| 10,132,588 | B2 * | 11/2018 | Salvador | F41A 21/325 |
| 10,184,745 | B1 | 1/2019 | Fulton | |
| 10,222,162 | B2 | 3/2019 | Adamson, Jr. | |
| 10,222,163 | B2 | 3/2019 | Couvillion | |
| 10,228,210 | B2 | 3/2019 | Parker | |
| 10,234,228 | B2 | 3/2019 | Person | |
| 10,254,068 | B2 | 4/2019 | Piemme et al. | |

(Continued)

*Primary Examiner* — Dedei K Hammond
*Assistant Examiner* — Jennifer B. Olson
(74) *Attorney, Agent, or Firm* — Parker Poe Adams & Bernstein, LLP; Timothy D. St. Clair

(57) ABSTRACT

A firearm suppressor is provided, including a tubular core, a baffle carried within the core, and a tubular mount. The core may be attached end-to-end to the mount. A cap may be attached end-to-end to the core opposite the mount. An intermediate member may be included, extending between the mount and the cap, and residing outboard of the core. The intermediate member may be welded to the mount and to the cap. The mount, the cap, and the intermediate member may be composed of one or more of titanium, aluminum, resins, polymers, composites, carbon fiber, and ceramics, whereas the core and the baffle may be composed of one or more of cobalt, nickel alloy, steel, stainless steel, and cobalt alloy.

20 Claims, 3 Drawing Sheets

(56) References Cited

U.S. PATENT DOCUMENTS

| | | | | |
|---|---|---|---|---|
| 10,267,586 | B1 | 4/2019 | Marfione | |
| 10,330,417 | B2 * | 6/2019 | Reis Green | F41A 21/30 |
| 10,488,139 | B1 | 11/2019 | Graham, II | |
| 2018/0202744 | A1 * | 7/2018 | De Sousa | F41A 21/34 |
| 2018/0299223 | A1 * | 10/2018 | Barrett | F41A 21/30 |

* cited by examiner

FIREARM SUPPRESSOR WITH COMPONENTS OF TWO OR MORE MATERIALS

CROSS REFERENCE TO RELATED APPLICATIONS

This application claims the benefit of priority of U. S. Provisional Application Ser. No. 62/884,920, filed on Aug. 9, 2019, which is incorporated herein in its entirety.

STATEMENT REGARDING FEDERALLY SPONSORED RESEARCH OR DEVELOPMENT

Not applicable.

THE NAMES OF PARTIES TO A JOINT RESEARCH AGREEMENT

Not applicable.

INCORPORATION-BY-REFERENCE OF MATERIALS SUBMITTED ON A COMPACT DISC OR AS A TEXT FILE VIA THE OFFICE ELECTRONIC FILING SYSTEM

Not applicable.

STATEMENT REGARDING PRIOR DISCLOSURES BY THE INVENTOR OR A JOINT INVENTOR

Not applicable.

BACKGROUND OF THE INVENTION

Field of the Invention

The present invention relates to a firearm suppressor and, more particularly, to a firearm suppressor comprising components of two or more materials.

Description of the Related Art

A conventional firearm operates by burning gunpowder to generate combustion gases that propel a projectile through the barrel of the firearm and out of the barrel muzzle. The rapidly expanding combustion gases exit the muzzle explosively, producing a characteristic loud report.

A suppressor (also sometimes referred to as a silencer) is a device attached to the muzzle of the firearm to reduce the noise of the discharging firearm. Suppressors are designed to reduce the noise created by the discharge by controlling and managing the energy levels of propellant gases emitted from the muzzle. Attenuation of such noise offers several advantages, such as mitigating damage to the hearing of the user.

The upstream end of a suppressor typically includes means for removably coupling the device to a weapon, and its downstream end includes an opening for the exit of the projectile. Typical suppressors include an elongated tubular housing containing one or more transverse baffles that define successive internal expansion chambers through which the projectile and expanding gasses pass after the weapon is fired. The baffles may be of various designs, and define a bore through which the projectile travels. These chambers serve to control, delay, and divert the flow, expansion, and exhausting of the propellant gases, and also to reduce their temperature and otherwise dissipate their energy, so as to achieve a corresponding reduction in the noise produced by the propellant gases as they ultimately exit the device.

The discharge of a firearm produces high temperature and high pressure propellant gases, a harsh environment for components exposed to such gases. Baffles, and the housing in which baffles are carried, need to be constructed of material that can withstand high heat and pressure to which they will be exposed during use. Further, after repeated firing, the hot gasses from the combusted propellant can erode the bore edges of the baffles. The bore is typically precisely dimensioned, and the clearance between the bore and the projectile affects the performance of the suppressor—a closer clearance may result in better performance of the suppressor in reducing discharge noise levels.

Improving the wear resistance of a baffle can extend the useful lifetime of the suppressor.

It is desirable for a firearm suppressor to be as lightweight as possible. Mounted at the muzzle of a firearm, the suppressor's mass increases the moment of inertia of the assembly, thereby slowing the angular acceleration of the assembly and reducing the ability to manipulate the firearm for target acquisition.

Titanium, for example, is a lightweight metal that would be desirable for use in fabricating a suppressor. Titanium has approximately half the weight of steel. However, titanium does not have desirable abrasion resistance and does not retain tensile strength at elevated temperatures as well as, for example, steel or cobalt alloy. Hot gases and unburnt powder tend to quickly erode impact surfaces, such as suppressor baffles, that are not parallel to the bore axis if made of titanium.

An ideal suppressor thus would use lightweight materials, such as for example titanium, in components that are parallel to the bore axis of the firearm, and stronger, harder, more abrasion resistant materials for components and/or surfaces that are not parallel to the bore axis.

A welded rifle suppressor is generally more durable and requires less service than a non-welded suppressor. A suppressor that was only threaded together with no welds may eventually unthread and cause a catastrophic and/or dangerous failure. However, it can be difficult to weld dissimilar materials together; for example, titanium and steel cannot be easily welded together.

In view of the foregoing, the present invention relates to an improvement upon the known systems and methods of firearm suppressors, and provides distinct advantages over the conventional systems and methods.

BRIEF SUMMARY OF THE INVENTION

An firearm suppressor with components of two or more materials is provided. As revealed in the following description and the figures herein, this invention discovers a durable, rugged, and lightweight firearm suppressor design.

In accordance with certain aspects of certain embodiments of the present technology, a firearm suppressor may comprise a tubular core, a baffle carried within the core, and a tubular mount. The core may be attached end-to-end to the mount. The suppressor may further include a cap, which may be attached end-to-end to the core opposite the mount. An intermediate member may be included, extending between the mount and the cap and residing outboard of the core. The mount, the cap, and the intermediate member may be composed of one or more of titanium, aluminum, resins, polymers, composites, carbon fiber, and ceramics, whereas the core and the baffle may be composed of one or more of cobalt, nickel alloy, steel, stainless steel, and cobalt alloy.

Other embodiments of the present technology may include one or more of the following:

(a) The intermediate member may be welded to the mount and to the cap;

(b) The surface of the intermediate member may be free of apertures;

(c) The intermediate member may include a hollow right circular cylinder;

(d) The baffle may be frustoconical; and/or (e) The baffle may be welded to the core.

In an alternate embodiment of the present technology, a firearm suppressor may comprise a mount that defines a hollow cylinder. The mount may have a first upstream end and a first downstream end, and the first downstream end may carry first threading of a first orientation. A core may be included, the core defining a hollow cylinder with a second upstream end and a second downstream end; the second upstream end may carry second threading that is complementary to the first threading of the mount; the second downstream end may carry third threading of a second orientation that is opposite the first orientation of the mount. A baffle may also be included, which may reside within the hollow cylinder of the core. Further, a cap may be included, the cap defining a third upstream end and a third downstream end, the third upstream end carrying a fourth threading that is complementary to the third threading of the core. The downstream end of the mount may be threaded to the upstream end of the core, and the downstream end of the core may be threaded to the upstream end of the cap. Any force urging two components to unthread from one another from threads of a first orientation would thus be counteracted by the force exerted by the threads of the second orientation, and vice versa. A collar may reside around the core and abut both the mount and the cap. The mount, the cap, and the collar may be composed of one or more of titanium, aluminum, resins, polymers, composites, carbon fiber, and ceramics. The core and the baffle may be composed of one or more of cobalt, nickel alloy, steel, stainless steel, and cobalt alloy.

Certain embodiments of the present technology may also include one or more of the following:

(a) The collar may be free of apertures;

(b) The collar may include a hollow right circular cylinder;

(c) The baffle may be frustoconical shaped and flare outwardly toward the cap;

(d) The collar may be attached to the mount; and/or (e) The collar may welded to the mount and to the cap.

In another embodiment of the present technology, a firearm suppressor may include a steel core that has an upstream end and a downstream end. The core may define a hollow cylinder that has internal threading of a first orientation within its upstream end and internal threading of a second orientation within its downstream end, the second orientation being opposite the first orientation. The suppressor may further include a baffle that is carried within the core. A mount may also be included, which may have an upstream end and a downstream end and may define a hollow cylinder. The mount may have internal threading of the first orientation of the core within its upstream and downstream ends. The suppressor may also include a cap that has upstream end and downstream ends, with external threading of the second orientation at its upstream end. Any force urging two of these components to unthread from one another from threads of one orientation would thus be counteracted by the force exerted by the threads of the opposite orientation, and vice versa. A hollow cylindrical sleeve may also be included, sized to reside around the core. The mount, the sleeve, and the cap may be composed of one or more of titanium, aluminum, resins, polymers, composites, carbon fiber, and ceramics. The upstream end of the core may be threaded to the downstream end of the mount, the upstream end of the cap may be threaded to the downstream end of the core, and the sleeve may be disposed between the mount and the cap and around the core.

Some embodiments of the present technology may also include one or more of the following:

(a) The surface of the sleeve may be free of apertures;

(b) The sleeve may include a hollow right circular cylinder;

(c) The baffle may be annular;

(d) The sleeve may be attached to the mount;

(e) The sleeve may be attached to the cap; and/or (f) The sleeve may be welded to the mount and to the cap.

Additional advantages of the invention will be set forth in part in the description which follows, and in part will be obvious from the description, or may be learned by practice of the invention. The advantages of the invention will be realized and attained by means of the elements and combinations particularly pointed out in the appended claims. It is to be understood that both the foregoing general description and the following detailed description are exemplary and explanatory only and are not restrictive of the invention, as claimed.

The purpose of the Abstract hereinabove is to enable the United States Patent and Trademark Office, and the public generally, to determine quickly from a cursory inspection the nature of the technical disclosure. The Abstract is not provided for interpreting the scope of the claims herein, nor to define the invention or the application, nor to be limiting in any way as to the scope of the invention.

BRIEF DESCRIPTION OF THE DRAWINGS

The details of the present invention, as to both its structure and its operation, can be understood with reference to the accompanying drawings, in which.

Figure 1:
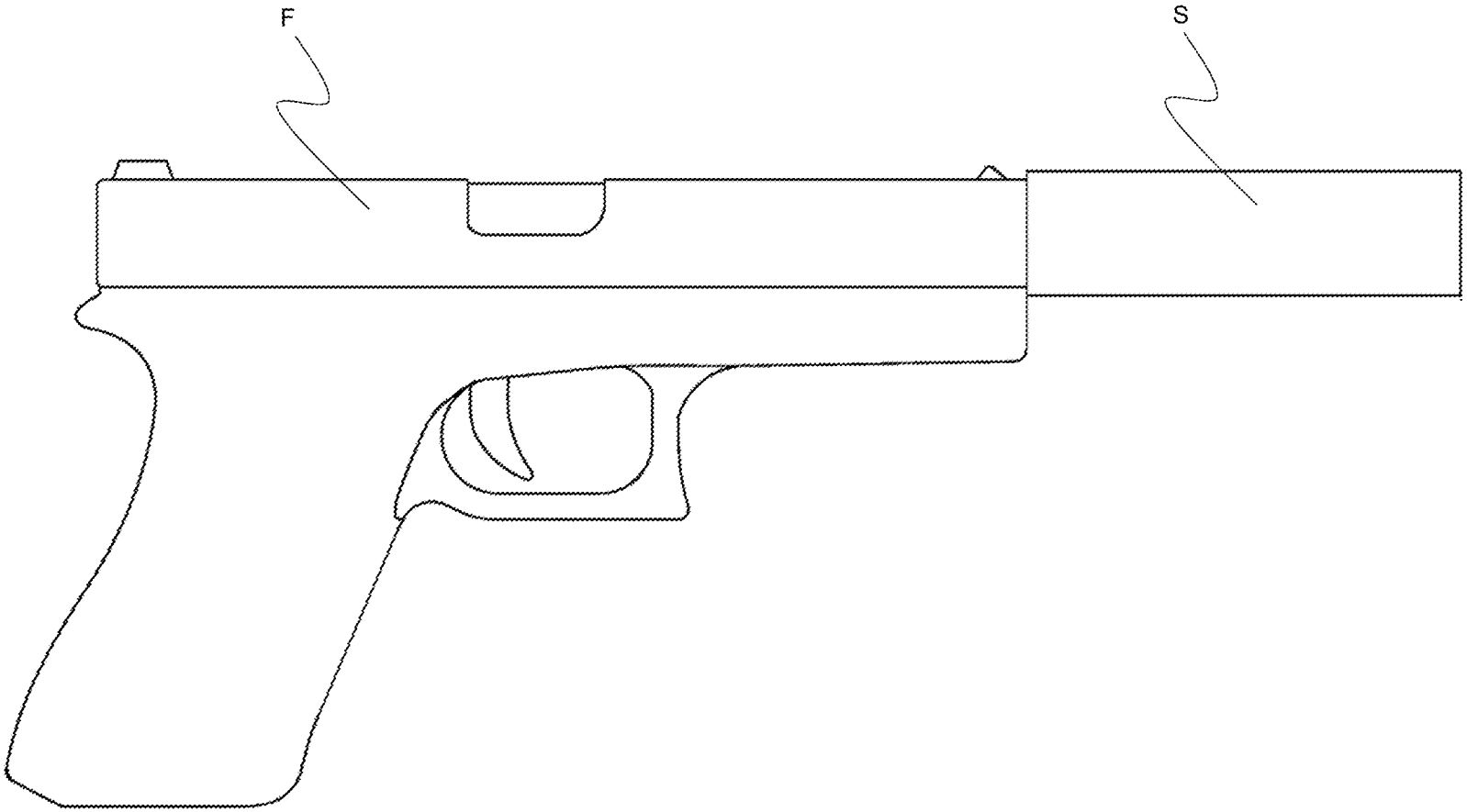
Fig. 1 (Prior Art)
FIG. 1 is a right side elevation view of a prior art combination of a firearm and a suppressor.

It should be noted that the drawings discussed above and below are not to scale in all instances, but may have exaggerated dimensions in some respect to illustrate the principles of the invention.

DETAILED DESCRIPTION OF REPRESENTATIVE EMBODIMENTS

Reference will now be made in detail to the presently preferred embodiments of the invention, one or more examples of which are illustrated in the drawings. Each example is provided by way of explanation of the invention, and is not meant as a limitation of the invention. For example, features illustrated or described as part of one embodiment may be used with a second embodiment to yield a third embodiment. It is intended that the present application include such modifications and variations as come within the scope and spirit of the invention. Repeat use of reference characters throughout the present specification and appended drawings is intended to represent the same or analogous features or elements of the invention.

Before any embodiments of the invention are explained in detail, it is to be understood that the invention is not limited in its application to the details of construction or to the arrangement of components set forth in the following description or illustrated in the drawings. The invention is capable of other embodiments and of being practiced or of being carried out in various ways. Also, it is to be understood that the phraseology used herein is for the purpose of description and should not be regarded as limiting. The use of formatives of the words "include," "comprise," and "have" is meant to encompass the items listed thereafter and equivalents thereof, as well as additional items. Unless specified or limited otherwise, the terms "connected" and "carried by" are used broadly and encompass direct and indirect mountings, connections, supports, or couplings. Further, such phraseology is not limited to physical or mechanical connections or couplings.

As used herein, the terms "upstream" and "downstream" refer to the relative location of components in a fluid pathway. Thus, in the context of a firearm suppressor, "upstream" is relatively closer to the muzzle of the firearm, and "downstream" is relatively further from the muzzle of the firearm.

A firearm suppressor is attached to the muzzle of a firearm. Such a suppressor is generally tubular shaped, with the axis of the tube aligned with the bore of the firearm. An exemplary prior art suppressor S is illustrated in FIG. 1 as so attached, to an exemplary firearm F, in this example a handgun.

Figure 2:
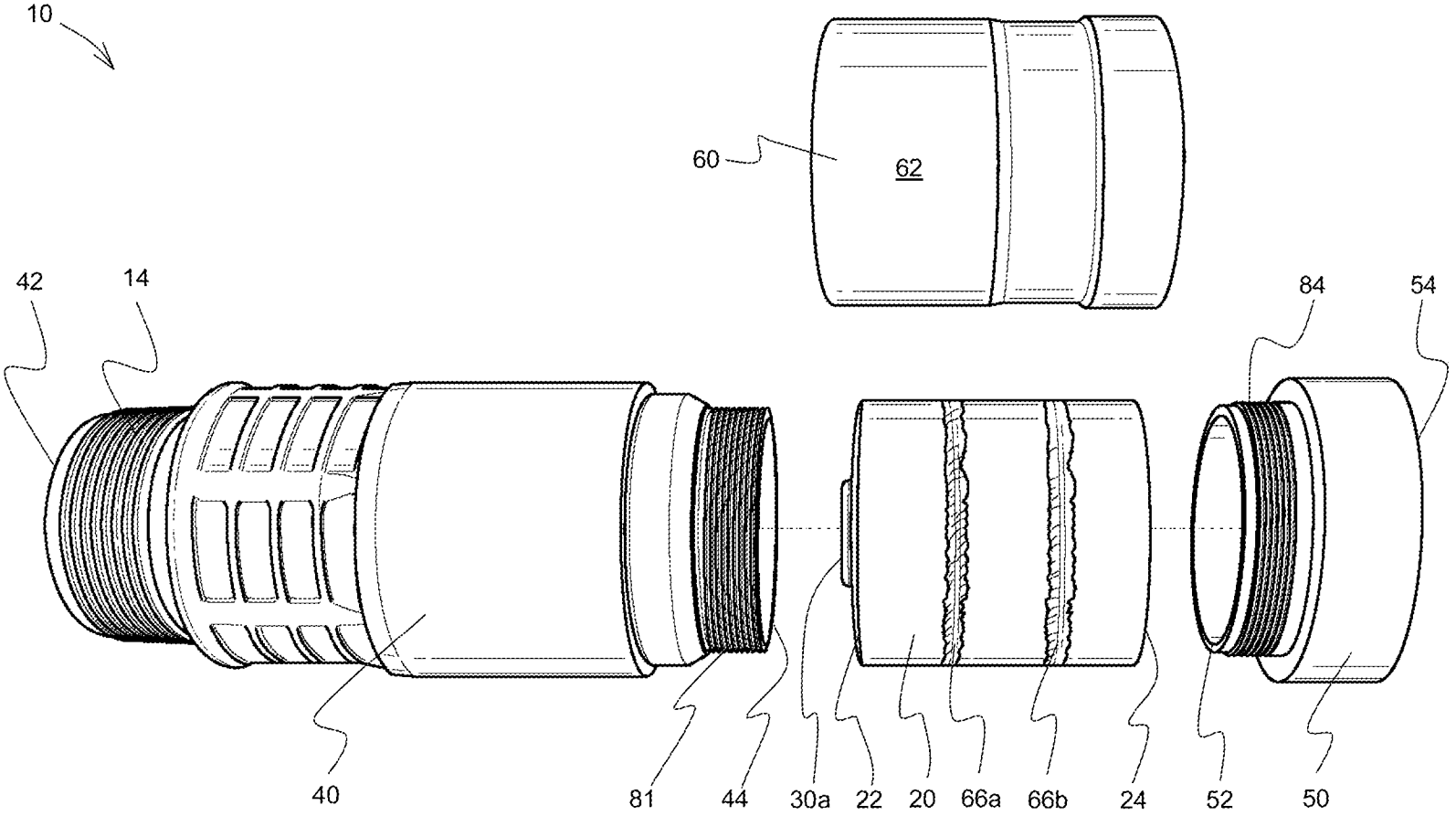
FIG. 2 is a disassembled perspective view of components of a suppressor according to an embodiment of the present invention.
Figure 3:
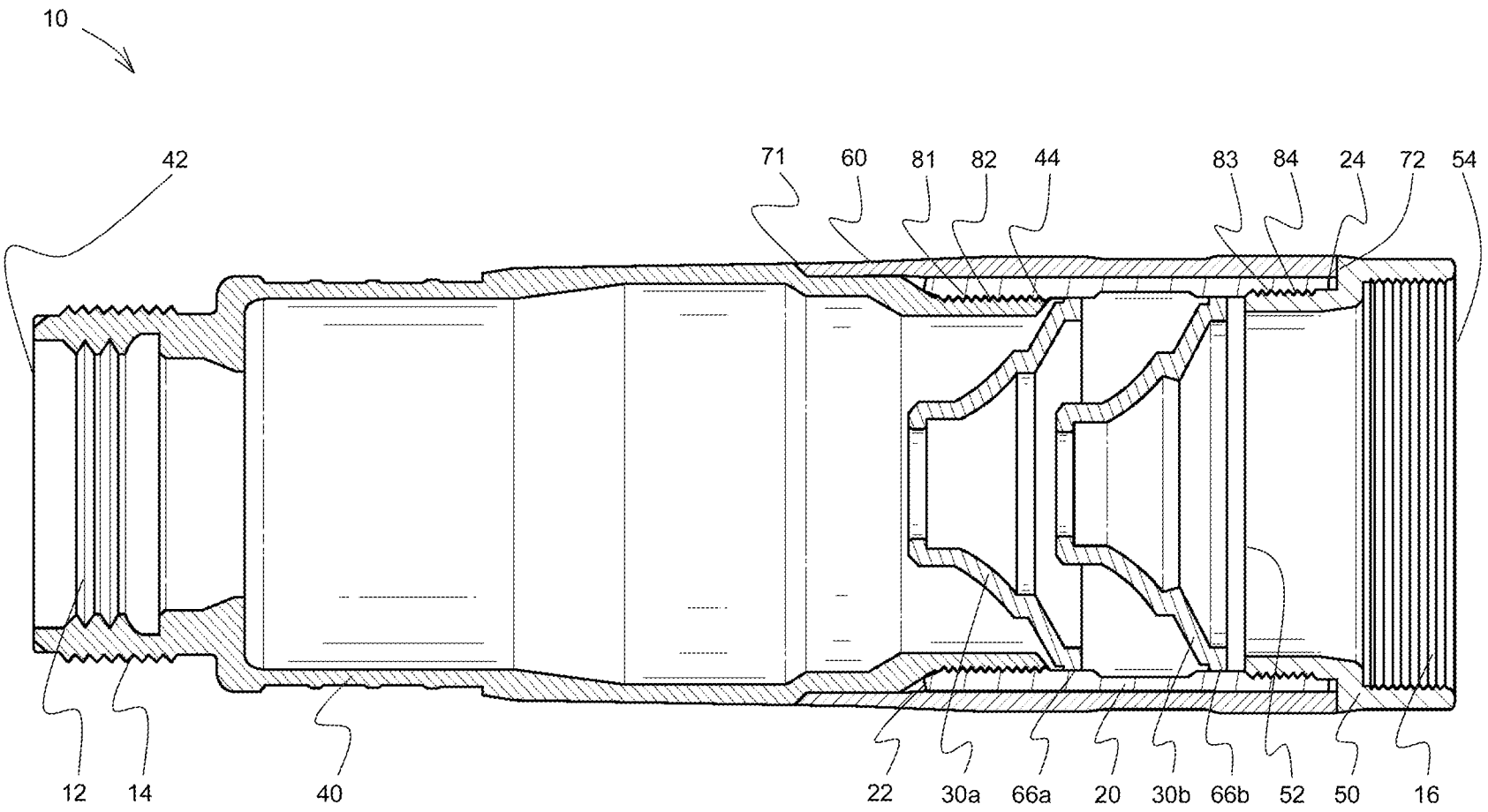
FIG. 3 is a sectional view, taken along the bore axis, of a suppressor according to an embodiment of the present invention.

The subject invention of suppressor 10 is illustrated in FIGS. 2 and 3. Suppressor 10 may include a mount 40, a core 20, a cap 50, and an intermediate member 60 that in some embodiments may also be referred to as a collar 60 and/or as a sleeve 60. One or more baffles 30, for examples baffles 30*a*, 30*b*, may be carried within core 20.

Mount 40 may be generally a hollow, tube-shaped body and/or a hollow cylinder. Mount 40 may include first attachment threading 12 and/or second attachment threading 14 residing proximate mount first upstream end 42, for attaching mount 40, directly or indirectly to the muzzle of a firearm. For example, first attachment threading 12 and/or second attachment threading 14 may be used to attach mount 40 to a firearm attachment locking system such as that disclosed in U.S. Pat. No. 9,921,021, the full disclosure of which is incorporated herein in its entirety. Alternatively, mount 40 may include other features, such as one or more flanges (not shown), that allow for the attachment of mount 40 to the muzzle of a firearm.

Mount 40 may be attached to a core 20 by several mechanical alternatives, such as by coupling lugs and grooves that mate.

Mount 40 may include first threading 81 proximate mount downstream end 44. First threading 81 may be of a first orientation, for example right-hand threading. First threading 81 may be external threading proximate mount downstream end 44, residing on the exterior of mount 40, as illustrated in FIG. 2, or first threading 81 may be internal threading proximate mount downstream end 44, residing on the interior of mount 40 (not shown).

Mount 40 may be composed of one or more of titanium, aluminum, resins, polymers, composites, carbon fiber, and ceramics.

Core 20 may be generally a hollow, tube-shaped body and/or a hollow cylinder. Core 20 may be attached to a cap 50 by several mechanical alternatives, such as by mating lugs and grooves that couple together. Core 20 may include second threading 82 proximate core second upstream end 22. Second threading 82 may be of an orientation complementary to first threading 81 of mount 40, such that core second upstream end 22 may be threaded with mount downstream end 44. For example, if first threading 81 is external threading, second threading 82 may be of internal, matching threading proximate core second upstream end 22 and interior to core 20. Alternatively, if first threading 81 is internal threading, second threading 82 may be of external, matching threading proximate core second upstream end 22 and upon surface 62 of core 20.

Core 20 may further include third threading 83 proximate core second downstream end 24. If first threading 81 and second threading 82 are of a first orientation, third threading 83 may be of a second orientation, the second orientation being opposite the first orientation. For example, if first threading 81 and second threading 82 are right-hand threadings, third threading 83 may be left-hand threading. Third threading 83 may be external threading proximate core second downstream end 24, residing on the exterior of core (not shown), or third threading 83 may be internal threading proximate core second downstream end 44, residing on the interior of core 20 as illustrated in FIG. 3.

Core 20 may carry one or more baffle 30 within its interior, for example baffles 30*a*, 30*b*. In some applications, baffle 30 may be welded to the interior of core 20, for example at baffle welds 66*a*, 66*b*; in other applications, baffle 30 may be positioned in core 20 by other mechanisms not involving weldment. Baffle 30 may be annular, conical, frustoconical, trumpet-shaped, and/or of other shapes. In one embodiment as illustrated in FIG. 3, baffles 30*a*, 30*b* are trumpet-shaped, with baffles 30*a*, 30*b* flaring outwardly toward core second downstream end 24.

Core 20 and baffles 30 may be composed of one or more of cobalt, nickel alloy, steel, stainless steel, and cobalt alloy.

A cap 50 may be configured for attachment to core second downstream end 24. Cap 50 may have a cap third upstream end 52 and a cap third downstream end 54. Cap 50 may include fourth threading 84 proximate cap third upstream end 52. Fourth threading 84 may be of an orientation complementary to third threading 83 of core 20, such that cap third upstream end 52 may be threaded to core second downstream end 24. For example, if third threading 83 is external threading, fourth threading 84 may be of internal, matching threading proximate cap third upstream end 52 and interior to cap 50 (not shown). Alternatively, if third threading 83 is internal threading, fourth threading 84 may be of external, matching threading proximate cap third upstream end 52, as illustrated in FIG. 3.

So configured, any force urging two connected components, such as mount 40 and core 20, to unthread from one another from threads of a first orientation would thus be counteracted by the force exerted by the threads of the second orientation, such as those connecting core 20 and cap 50, and vice versa.

Suppressor 10 may also include an intermediate member 60, also in some embodiments referred to as collar 62 and sleeve 62. Intermediate member 60 may extend between mount 40 and cap 50 in an assembled suppressor 10, as illustrated in FIG. 3. Some instances of intermediate member 60 include, in whole or in part, a hollow right circular cylinder. In some configurations, intermediate member 50 may reside around core 20, and in certain aspects of such configurations intermediate member 50 may define a hollow cylinder, although in other configurations intermediate member 60 may extend between mount 40 and cap 50 without residing around core 20. In individual instances of suppressor 10, intermediate member 60 may include an exterior surface 62; in specific representations of such instances, exterior surface 62 may be free of apertures, whereas in other representations apertures may extend into or through exterior surface 62 to core 20 (not shown) for advantageous reasons, such as for example further reduction in weight or to provide an advantageous gripping surface.

Intermediate member 50 may be composed of one or more of titanium, aluminum, resins, polymers, composites, carbon fiber, and ceramics.

As to a suppressor 10 in which a core 20 is attached end-to-end to a mount 40 and a cap 50 is attached end-to-end to the core 20 opposite the mount 40, with an intermediate member 60 extending between the mount 40 and the cap 50, suppressor 10 may include intermediate member 60 being welded to mount 40, to cap 50, or to both mount 40 and cap 50. With an intermediate member 60 extending between a mount 40 and a cap 50 and being welded to both, any force urging two connected components, such as mount 40 and core 20, or such as core 20 and cap 50, to disconnect from one another would thus be resisted by the weldment of intermediate member 60 to both mount 40 and cap 50.

FIG. 2 illustrates an embodiment of suppressor 10, in disassembled form. As illustrated in FIG. 2, suppressor 10 includes a core 20 having an upstream end 22 and a downstream end 24, defining a hollow cylinder having internal threading 82 of a first orientation within its upstream end 22 and having internal threading 83 of a second orientation within its downstream end 24, internal threading 82 being opposite internal threading 83. Baffles 30*a*, 30*b* are carried within core 20 (not shown). Mount 40 has an upstream end 42 and a downstream end 44, and defines a hollow cylinder having external threading 12 of the first orientation within its upstream end 42. Mount 40 has external threading of the first orientation at its downstream end 44. Also included is a cap 50 having an upstream end 52 and a downstream end 54. Cap 50 has external threading 84 of the second orientation at its upstream end 52. Finally, sleeve 60 is included, sleeve 60 defining a hollow cylinder sized to reside around the core 20. The upstream end 22 of the core 20 is configured for being threaded to the downstream end 44 of the mount 40, the upstream end of the cap is configured for being threaded to the downstream end 24 of the core 20, and the sleeve 60 is configured for being disposed between the mount 40 and the cap 50 and around the core 20. In the embodiment of FIG. 2, the surface 62 of sleeve 60 is free of apertures.

FIG. 3 illustrates an embodiment of suppressor 10, in assembled form. As illustrated in FIG. 3, suppressor 10 includes a mount 40 defining a hollow cylinder with a first upstream end 42 and a first downstream end 44, the first downstream end 44 carrying first threading 81 of a first orientation. A core 20, defining a hollow cylinder, has a second upstream end 22 and a second downstream end 24, the second upstream end 24 carrying second threading 82, the second threading 82 being complementary to the first threading 81. Core 20 second downstream end 24 carries third threading 83 of a second orientation, the second orientation being opposite the first orientation. Baffles 30*a*, 30*b* reside within the hollow cylinder of core 20. A cap 50 is also attached to the assembly, cap 50 having third upstream end 52 and a third downstream end 54, the third upstream end 52 carrying fourth threading 84 that is complementary to the third threading 83. The downstream end 44 of mount 40 has been threaded to upstream end 22 of core 20. Downstream end 24 of core 20 has been threaded to upstream end 52 of cap 50. A collar 60 resides around core 20 and abuts both mount 40 and cap 50. Baffles 30*a*, 30*b* are frustoconical shaped and flare outwardly toward cap 50. Collar 60 has been welded at first weld 71 to mount 40 and at second weld 72 to cap 50. The embodiment illustrated in FIG. 3 includes both internal threading 12 and external threading 14 at mount first upstream end 42, which provides greater flexibility in the manner of attaching, by direct attachment or by indirect attachment via a transitional component, suppressor 10 to a firearm. Also, the embodiment illustrated in FIG. 3 includes third attachment threading 16 at cap downstream end 54, allowing for downstream attachment of other firearm accessories.

Suppressor 10 thus may have components of two or more materials. Suppressor 10, thus configured, provides a durable, rugged, and lightweight firearm suppressor design.

It should be appreciated that, in the above description of embodiments, various features are sometimes grouped together in a single embodiment, figure, or description for the purpose of streamlining the disclosure and aiding in the understanding of one or more of the various inventive aspects. This method of disclosure, however, is not be interpreted as reflecting an intention that any claim requires more features than are expressly recited in that claim. Moreover, any components, features, or steps illustrated and/or described in a particular embodiment herein, can be applied to or used with any other embodiment. Thus, it is intended that the scope of the inventions herein disclosed should not be limited by the particular embodiments described above, but should be determined only by a fair reading of the claims that may issue from the benefit of the within disclosure.

The invention claimed is:

1. A firearm suppressor, comprising:

a one-piece tubular core defining an upstream end and a downstream end, the upstream end having a first threading and the downstream end having a second threading that is opposite the first threading;

a baffle, the baffle carried within the core;

a tubular mount, the core attached by the first threading to the exterior of the mount;

a cap, the cap attached to the core opposite the mount by the second threading;

an intermediate member, the intermediate member extending between the mount and the cap and welded to both, and residing outboard of the core;

the mount, the cap, and the intermediate member being composed of a first material; and the core and the baffle being composed of a second material different than the first material.

2. The firearm suppressor of claim 1, in which the first material is titanium.

3. The firearm suppressor of claim 1, in which the surface of the intermediate member is free of apertures.

4. The firearm suppressor of claim 1, in which the intermediate member includes a hollow right circular cylinder.

5. The firearm suppressor of claim 1, in which the baffle is frustoconical.

6. The firearm suppressor of claim 1, in which the cap is attached to the interior of the core.

7. A firearm suppressor, comprising:

a mount, the mount defining a hollow cylinder with a first upstream end and a first downstream end, the first downstream end carrying first threading of a first orientation;

a core, the core defining a hollow cylinder with a second upstream end and a second downstream end, the second upstream end carrying second threading, the second threading being complementary to the first threading, the second downstream end carrying third threading of a second orientation, the second orientation being opposite the first orientation;

a baffle, the baffle welded to the interior of the hollow cylinder of the core;

a cap, the cap defining a third upstream end and a third downstream end, the third upstream end carrying a fourth threading, the fourth threading being complementary to the third threading;

the downstream end of the mount being threaded to the upstream end of the core, the downstream end of the core being threaded to the upstream end of the cap;

a collar, the collar residing around the core and welded to both the mount and the cap; and the core overlaps the mount and the collar overlaps the core where the core overlaps the mount.

8. The firearm suppressor of claim 7, in which the surface of the collar is free of apertures.

9. The firearm suppressor of claim 7, in which the core is one-piece, the firearm suppressor includes a plurality of baffles, and the plurality of baffles reside within the one-piece core.

10. The firearm suppressor of claim 7, in which the core overlaps the cap and the collar overlaps the core where the core overlaps the cap.

11. The firearm suppressor of claim 7, in which the baffle and the core are cobalt alloy.

12. The firearm suppressor of claim 7, in which the mount, cap, and collar are titanium.

13. The firearm suppressor of claim 7, in which weldments reside only between components of the same material.

14. A firearm suppressor having a bore axis, comprising:

a core, the core:

being composed of a first material;

having an upstream end and a downstream end;

defining a hollow cylinder;

having internal threading of a first orientation within its upstream end;

having internal threading of a second orientation within its downstream end, the second orientation being opposite the first orientation;

a baffle, the baffle being composed of a second material and attached to the interior of the core;

a mount, the mount:

having an upstream end and a downstream end;

defining a hollow cylinder;

having internal threading of the first orientation within its upstream end;

having external threading of the first orientation at its downstream end;

a cap, the cap:

having an upstream end and a downstream end;

having external threading of the second orientation at its upstream end;

a sleeve, the sleeve:

defining a hollow cylinder;

sized to reside around the core;

a radius extending perpendicular to the bore axis, the radius intersecting the mount, the core, and the sleeve, the mount being closer to the bore axis than the core at the radius and the core being closer to the bore axis than the sleeve at the radius;

the mount, the sleeve, and the cap being composed of a third material that is different than the first material; and the upstream end of the core being threaded to the downstream end of the mount, the upstream end of the cap being threaded to the downstream end of the core, and the sleeve being disposed between the mount and the cap and welded to both.

15. The firearm suppressor of claim 14, in which the surface of the sleeve is free of apertures.

16. The firearm suppressor of claim 14, in which the sleeve includes a hollow right circular cylinder.

17. The firearm suppressor of claim 14, in which the baffle is annular.

18. The firearm suppressor of claim 14, in which the mount is of one-piece construction.

19. The firearm suppressor of claim 14, further including weldments, the weldments residing only between adjacent components of the same material.

20. The firearm suppressor of claim 14, further including a second radius extending perpendicular to the bore axis, the second radius intersecting the cap, the core, and the sleeve, the cap being closer to the bore axis than the core at the second radius and the core being closer to the bore axis than the sleeve at the second radius.

* * * * *